US009205896B2

(12) United States Patent
Mueller

(10) Patent No.: US 9,205,896 B2
(45) Date of Patent: Dec. 8, 2015

(54) PLATFORM STAIRS

(71) Applicant: Peter A. Mueller, Gattikon (CH)

(72) Inventor: Peter A. Mueller, Gattikon (CH)

( * ) Notice: Subject to any disclaimer, the term of this patent is extended or adjusted under 35 U.S.C. 154(b) by 0 days.

(21) Appl. No.: 14/423,307

(22) PCT Filed: Aug. 19, 2013

(86) PCT No.: PCT/CH2013/000145

§ 371 (c)(1),
(2) Date: Feb. 23, 2015

(87) PCT Pub. No.: WO2014/029037

PCT Pub. Date: Feb. 27, 2014

(65) Prior Publication Data

US 2015/0203177 A1 Jul. 23, 2015

(30) Foreign Application Priority Data

Aug. 21, 2012 (CH) ..... 1436/12
Oct. 1, 2012 (CH) ..... 1802/12
Jul. 19, 2013 (CH) ..... 1292/13

(51) Int. Cl.
*B63B 17/00* (2006.01)
*B63B 27/14* (2006.01)
*B63B 1/22* (2006.01)

(52) U.S. Cl.
CPC . *B63B 27/14* (2013.01); *B63B 1/22* (2013.01); *B63B 27/146* (2013.01)

(58) Field of Classification Search
USPC ..... 114/362
IPC ..... B63B 17/00,27/14, 27/146, 1/22
See application file for complete search history.

(56) References Cited

U.S. PATENT DOCUMENTS 4,733,752 A 3/1988 Sklar
6,789,648 B2 9/2004 Cook
6,834,875 B2 * 12/2004 Leitner ..... B60R 3/02 105/447
7,121,226 B2 10/2006 Grimaldi
7,637,519 B2 * 12/2009 Leitner ..... B60R 3/02 280/163
7,740,261 B2 * 6/2010 Leitner ..... B60R 3/02 280/163
7,766,357 B2 * 8/2010 Arvanites ..... B60R 3/007 182/127
2007/0113773 A1 5/2007 Nakano
2011/0017122 A1 1/2011 Muller
2013/0000542 A1 1/2013 Muller

FOREIGN PATENT DOCUMENTS

CH 702 460 A2 6/2011
WO 2009062331 A2 5/2009

OTHER PUBLICATIONS

Feb. 3, 2014 International Search Report issued in International Application No. PCT/CH2013/000145.

* cited by examiner

*Primary Examiner* — Stephen Avila
(74) *Attorney, Agent, or Firm* — Oliff PLC

(57) ABSTRACT

The invention relates to stairs that are attached under the platform and can be swung out and are distinguished in that the steps remain positionally stable horizontally when the stairs are swung out, and the bottom steps form a cover and optionally a flow body, and once the stairs are swung out, they form means for climbing in and out of the water, a seat element, function as a trim tab and damping means and, when the swinging arms are swung out further, constitute an additional platform, and the swinging ladder consists of ladder elements and can be folded by means of a cam and a bracket, and the stairs and swinging ladder as a stairway can have a handrail which can be swung out manually or automatically.

14 Claims, 2 Drawing Sheets

PLATFORM STAIRS

TECHNICAL FIELD

The invention is based on pivotable stairs that are located under a swimming or tender platform according to the preamble of the first claim.

PRIOR ART

Unfoldable, lowerable or otherwise adjustable stairs are known that are extended manually or by a motor, and the stairs can also be adjusted frequently. These stairs are positively adjusted with external pushrods or by means of chain drives.

Likewise, stern parts that can be folded out are known which serve as a swimming platform or as a support for unloading or loading dinghies.

With watercraft, stairs extendable from the hull or swimming platform are known as for example described in U.S. Pat. No. 6,789,648 B2, or parts of the swimming platform on which step elements are found are lowered in an arc into the water as described in U.S. Pat. No. 7,121,226 B2, or a scissors lift with manual actuation in U.S. Pat. No. 4,733,752.

DESCRIPTION OF THE INVENTION

The object of the invention is to attach stairs that can be swung out onto a platform, or onto a platform or lifting platform configured with side supports in the terrestrial as well as nautical sphere.

This is brought about by means of adjustable steps which can be unfolded from a closed position into a desired position for a corresponding activity, and the position of the individual steps remains constant when the stairs are swung, wherein the bottom step also serves as covering means, or also functions as a buoyancy element in the nautical sphere and has a folding hinge with a guide element when it is a ladder such that the ladder is necessarily unfolded at a specific location.

Serving as an example is a watercraft that has a swimming or tender platform—platform for short—on its stern, and stairs are attached to the bottom side. Different than ladders which have rungs, stairs have treads and are therefore comfortable to step on barefoot. Those which have adjustable treads remain positionally stable when swinging out and require correspondingly less space in a closed state.

For commercial or recreational purposes, watercraft require access to water which can be easily and economically realized with a ladder or stairs. Such ladders are frequently installed under a cover on the platform or located under the platform in a box in which a ladder or stairs are stored that can be extended and then lowered manually or by technical means.

People can hence enter or exit the water comfortably and, when the stairs are large, they can also serve as a support for water skis or wake boards so that the athlete can for example step in the bindings with less effort.

Ladders on the platform are economical, but they are not particularly comfortable to handle and cannot be used for other purposes than just as an aid for climbing in and out. Stairs in this regard are significantly more comfortable; however, insertion and removal from the box is technically involved, or the shifting mechanism can become skewed in the box, thus rendering such stairs useless.

The invention proceeds against this backdrop in that the stairs do not have an adjustment rod; instead, they can be swung freely and directly downward about a rotary axis. In a closed state, the stairs which can swing out are located practically within the platform since it is mostly hollow; in addition, a corresponding recess is created at this location so that the stairs are realized as a recessed, integrated element in the platform. The last step, which can also be an independent platform and simultaneously covers the bottom part of the platform, also has a hydrodynamic function so that, when the watercraft is traveling, the spray water and foam behind the stern is diverted in a streamlined manner by means of the smooth, correspondingly shaped subfloor of the stairs. This last step can also be designed to possess a trim tab function, i.e., generates dynamic buoyancy, during travel, and is designed as a buoyancy element that generates static buoyancy when the watercraft is at a standstill.

These stairs are swung out by means of a set of swinging arms which are advantageously on both sides of the stairs, constitute a parallelogram and are moved by an operating cylinder. Given the bottom step that can also be designed as a cover and flow body, the bottom step can have generous dimensions so that one or more people can sit pleasantly on the step and sit above or just below the water line depending on the swing-out angle, or there is enough space e.g. to attach a water ski to a foot or put on scuba tanks, or grasp the step after swimming and climb on it with little effort. The safety and utility in handling such stairs can be further enhanced by using electronic aids.

In addition, a ladder can be manually unfolded on the stairs, or additional stairs or a ladder can be automatically unfolded when extending the stairs for climbing down lower into the water and climbing out of the water more easily.

In any case, a handrail is quite useful when climbing in and out of the water and can be attached to the stairs so that they can be manually or automatically unfolded.

According to the invention, this is achieved by the features of the first claim.

The core of the invention is that, with stairs to which handrails can be attached that are manually or automatically extendible, the stairs are distinguished in that the steps remain in a stable horizontal position with a parallelogram when the stairs are swung out, and the bottom step constitutes a platform for climbing in and out and for sitting and simultaneously serves as a cover and flow body, and the ladder can be additionally mounted thereupon and can serve as a trim tab once the stairs are partially swung out.

Additional advantageous embodiments of the invention will become apparent from the dependent claims.

BRIEF DESCRIPTION OF THE DRAWINGS

In the following, exemplary embodiments of the invention will be further explained with reference to the drawings. In the different figures, the same elements are provided with the same reference signs.

In the figures.

Only those elements are schematically portrayed which are essential for immediately understanding the invention.

Way to Design the Invention

Figure 1:
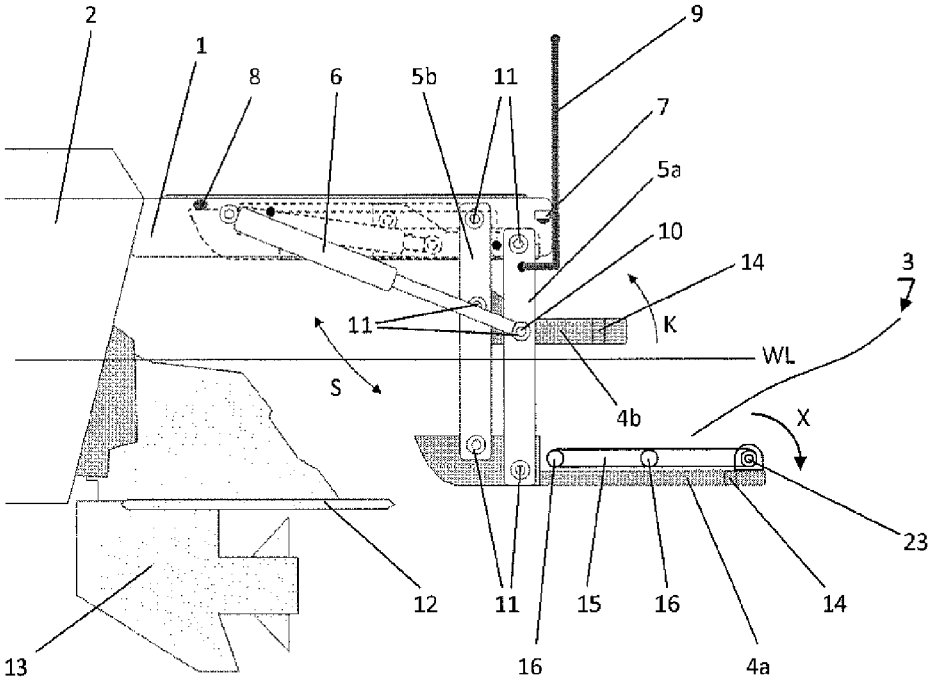
FIG. 1 shows a schematic side view of a platform with stairs that are attached underneath and can be swung out with two adjustable steps on a parallelogram which are activated by an operating cylinder, as well as an unfolding handrail, unfolding ladder, and an emergency switch and safety switch.

FIG. 1 shows a schematic side view of pivotable stairs 3 on a watercraft 2 attached under the platform 1 and having two adjustable steps 4*a*, 4*b* on a set of swinging arms 5*a*, 5*b* that form a parallelogram, of which one is actuated by an operating cylinder 6, and having an emergency switch 7, a safety switch 8 and an unfolding handrail 9.

Since most platforms 1 are hollow and a recess can be created in the closed platform 1, stairs 3 can be integrated almost entirely under such a platform 1. The swinging arms 5 that are attached on both sides of the respective steps 4*a*, 4*b* can be attached horizontally as a parallelogram with minimum height. The operating cylinder 6 which is attached or placed in the middle on both sides of the parallelogram, such as on the rotary bar 10 that advantageously connects the two swinging arms 5*a* and simultaneously rotatably bears the step 4*b*, activates the stairs 3.

The button is not shown that activates the operating cylinder 6, which can be an electric or hydraulic cylinder and that extends and retracts the stairs 3 and maintains the desired swung-out position. A swinging arm lock which may be separate is not shown. The advantage is that the step 4*a* forms a cover on one hand and constitutes means on the other hand to be stood on, for sitting, or for laying down equipment such as scuba tanks. Depending on the design of the operating cylinder 6, the swinging arms 5 can be moved by an angle of practically 180° so that heavy goods such as the aforementioned scuba tanks are completely lift up, and then correspondingly moved on to the platform 1 with a slight amount of effort, and then the stairs 3 are subsequently swung completely closed under the platform 1.

The step 4*b* is also displayed which constitutes an intermediate step when the swinging arms 5*a*, 5*b* are long to facilitate climbing up and down. The step 4*b* is pivotably mounted securely on the swinging arm Sb by means of the pivot bearing 11, and is only placed on the rotary bar 10 so that, when swinging out the stairs 3, no objects can become clamped between the step 4*a* and step 4*b*. Furthermore, the step 4*b* can be swung up following arrow K and form a comfortable backrest when someone is sitting on the step 4*a*. The step 4*b*, and the top of the step 4*a*, can be covered with a PUR plastic and hence constitute a pleasant foam cushioning.

Figure 2:
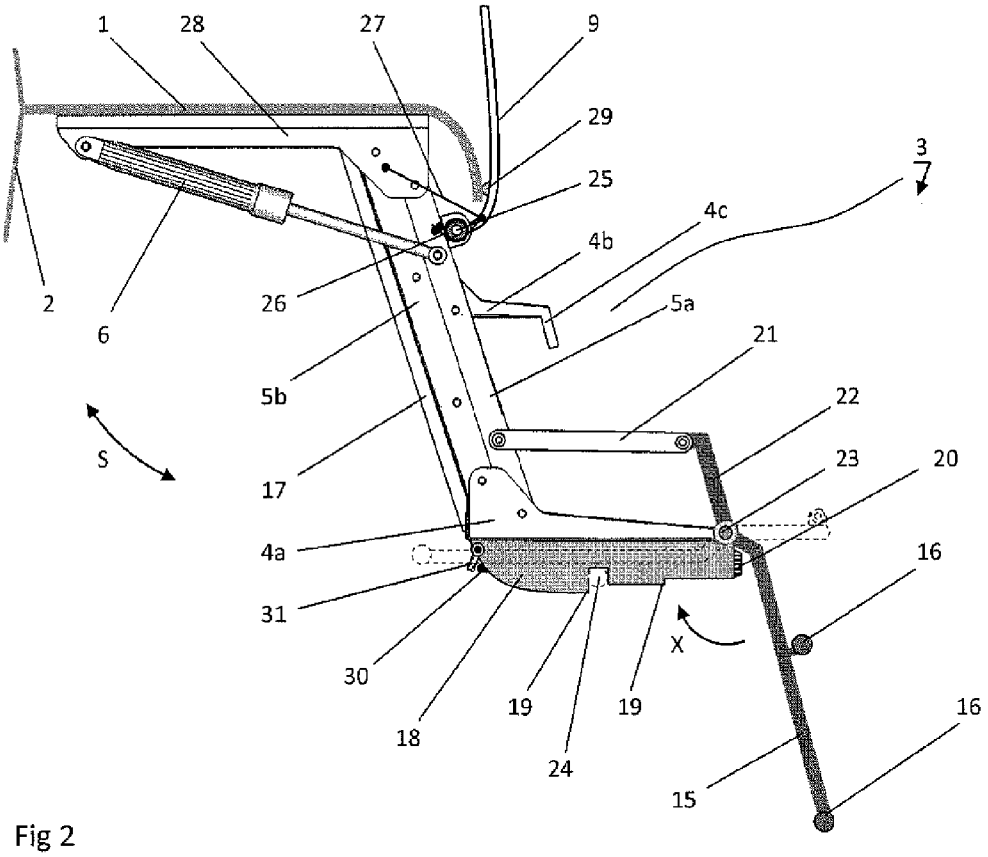
FIG. 2 shows a schematic side view of a platform with stairs that are attached underneath and can be swung out with two adjustable steps on a parallelogram which are activated by an operating cylinder, as well as an additional, automatically unfolding ladder and underwater lamp in a tiered buoyancy element.

The steps 4*a*,4*b* can be designed ergonomically and have technical means 14, e.g. be equipped with a bar guide which allows a portable grill to be inserted so that the cockpit of the watercraft 2 remains protected from smoke and oil spatter, or underwater lamps can be placed in the step 4*a*,4*b* (see FIG. 2).

Of course, the step 4*b* can also be moved lengthwise and assume a shape and position such that, when the swinging arms 5*a*,5*b* have been entirely swung out, the step 4*a* and step 4*b* basically form a platform surface behind the platform 1 and thereby correspondingly enlarge the overall platform.

The step 4*a*, which also serves as a bottom cover for the platform 1, can also have a hydrodynamic shape so that foam and spray water are deflected in a very streamlined manner since a certain amount of water turbulence measurably reduces the efficiency of the watercraft during travel. Likewise, the step 4*a* helps while starting, especially with heavy yachts and heavily loaded sports boats, so that the vehicle can very quickly commence planing since it constitutes a giant trim tab. A flat position of the bottom side of the step 4*a* is sufficient since the hull of the watercraft 2 is enough to contribute to a (problematic) adjustment angle in the start phase. If the step 4*a* is equipped with a V-shaped hydrodynamic floor part, i.e., a deadrise like the boat hull, it also improves the directional stability in the start phase. If the stairs 3 are appropriately equipped technically and in terms of materials, the step 4*a* can also be used as a trim tab during travel since the water line WL while planing is at the height of a cavitation plate 12 of a Z-drive 13. In this case, the front side of the step 4*a* must be designed so that no flowing water comes over the step 4*a* but rather can only flow on its bottom side.

If the watercraft is anchored, the extended stairs 3 with the step 4*a* can also serve as a buoyancy element since it has a corresponding buoyancy volume. If it is designed with a closed-cell plastic, such a buoyancy element is unsinkable, and the static buoyancy generates upward buoyancy as a compensation to the weight of people or equipment that are on the step 4*a* or platform 1 and exert a downward force.

In addition, the stairs 3 swung out for example 90° function to dampen rolling and pitching in waves at anchor since the water flowing more or less vertically against the step 4*a* in waves correspondingly flows around the step 4*a* that thereby constitutes a solid hydrodynamic brake.

In addition, a ladder 15 can be attached to the step 4*a* correspondingly mounted with the pivot bearing 23, wherein the ladder 15 rests on the step 4*a* when in disuse. If a seat cushion is attached to the step 4*a*, recesses can be created that leave the required space for the ladder 15 with its rungs 16. Accordingly, the ladder can be unfolded with a single handle according to arrow X to enable an additional, comfortable descent into the water, or enable easier climbing of a rung 16 underwater and hence easier climbing up onto the step 4*a*.

Under the platform 1, there is also an electrical, watertight emergency switch 7 so that, in case somebody falls into the water, they can independently press the emergency switch 7 and thereby extend the stairs 3. There is also a safety switch 8 under the stairs 3 which prevents the stairs 3 from being downwardly movable in a collision when a watercraft 2 has a Z-drive 13 that is lifted up. Likewise, the safety switch 8 can first cause the steering of the Z-drive 13 to straighten out when swinging out the stairs 3 so that the swinging arms 5*a*, 5*b* also do not undergo a collision with the Z-drive 13.

Otherwise, the safety switch 8 also serves to enable the detection of the top end position of the stairs 3 and, when it is linked to the tachometer and controller, limits the engine speed, or the engine cannot be started at all, or an alarm sounds as long as the stairs 3 are not fully lifted up. A separate button assignment is provided for the trim tab control, and an angle sensor or stroke sensor on the operating cylinder 6 (not shown) ensures that the step 4*a* can only be operated within a specific swinging-out range.

Stairs 3 without a good handrail 9 are only inferior stairs; a handrail 9 is therefore attached to the swinging arm 5*a* which automatically swings out the handrail by means of forced transmission between the swinging arm 5*a* and handrail 9. Such forced transmission can for example be achieved with toothed wheels. Or the hand rail 9 is swung out manually and is mechanically locked in the desired position, or the handrail 9 is folded out and held by means of an electrical or hydraulic actuator, in particular when the actuator also has an angle sensor on one of the swinging arms 5*a*,5*b*, or has a stroke pickup on the operating cylinder 6 so that, by means of a controller, the algorithm can be set so that when the swinging arms 5*a*,5*b* are swung out, the handrail 9 is vertical as of a specific angular value, and the handrail 9 remains vertical when the swinging arms 5*a*,5*b* are swung out further.

The controller is not shown that, inter alia, assumes the synchronization of two electrical operating cylinders.

FIG. 2 shows a schematic side view of pivotable stairs 3 on a watercraft 2 attached under the platform 1 and having two adjustable steps 4*a*,4*b* on a set of swinging arms 5 that form a parallelogram, covered by the cover 17, of which one swinging arm 5*a* is actuated by an operating cylinder 6. Furthermore, the step 4*a* has a positively controlled ladder 15 as well as a buoyancy element 18 with steps 19 and integrated LED lamps 20.

With large yachts, the stairs 3 which can be swung out may have additional steps 4*a*, 4*b*; however, a positively controlled ladder 15 is space-saving and light that has an adjusting rod 21 which is connected on the one hand to the swinging arm 5*a* and the ladder grip 22 and swings out the ladder 15 by means of the pivot bearing 23 and has the same angle in this case as the stairs 3 which can be swung out. This allows a person to stand deeper in the water, or a person can grab one of the rungs 16 more quickly after swimming.

Figure 3:
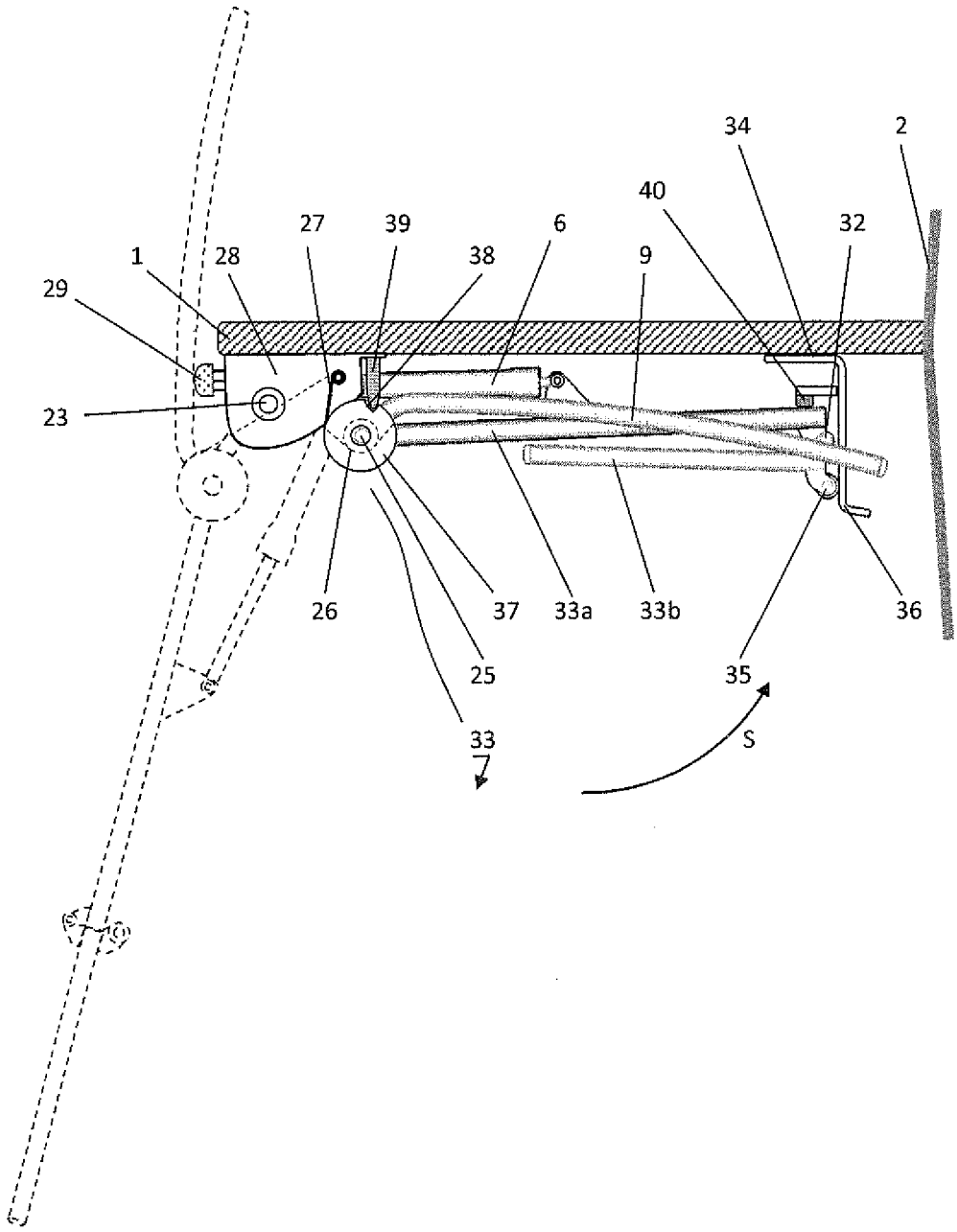
FIG. 3 shows a schematic side view of a platform with a ladder attached underneath that can be swung out consisting of two ladder elements and held by a hinge with an automatically unfolding handrail and a bracket.

Extending the ladder 15 is also possible as described in FIG. 3. In addition, the parallelogram consisting of the swinging arms 5*a*, 5*b* is enclosed by the cover 17. This can be achieved by means of a U-shaped swinging arm 5*a* and the swinging arm 5*b* lying therein, or a metal or plastic sleeve surrounds the two swinging arms 5*a*, 5*b*. This ensures that no one can insert his hand or fingers or any other member into the parallelogram and damage it at any time. Alternatively, the swinging arms 5*a*, 5*b* must be positioned sufficiently far from each other.

The step 4*b* can also have an angled element as a backrest 4*c* if the step 4*a* is long enough. This can also serve as a hydrodynamic element in the closed or half-closed states. The streamlined buoyancy element 18 is an element that can generate static as well as dynamic buoyancy and therefore has steps 19 which result in a stall starting at a given speed and hence reduces the friction on the buoyancy element 18. Furthermore, the buoyancy element can have a deadrise that stabilizes the course upon contacting water. Ideally, there is a recess 24 in one of the steps 19 for the rung 16 of the positively actuated ladder 15 that can swing out, or the rung 16 itself forms a termination of a stalling step 19. Furthermore, the buoyancy element 18 can simultaneously serve as a carrier of LED lamps that illuminates under water behind the watercraft when the stairs 3 are partially swung out, or potential hindrances would be discerned when the stairs 3 are raised when backing into a harbor similar to the backup lights of an automobile.

Instead of a positively controlled ladder 15, stairs can of course also be used, i.e., any horizontal treads that are positionally stable at any pivot angle by means of an additional parallelogram.

The handrail 9 in this case is fastened to the swinging arm 5*a* by being pivotably mounted, wherein the handrail 9 has a pin 25, and the spring 26 contacts the handrail 9 on the one hand and the swinging arm 5*a* on the other hand. A rope 27 which is a steel or high-quality plastic rope is attached to the handrail 9 as well as the chassis 28. In the extended position of the stairs 3, the handrail 9 is swung out into the desired position, i.e., the rope 27 is taut which prevents the handrail 9 from being pulled to the rear. For securing towards the front, a stop 29 is attached to the handrail 9 so that it remains fixed in position.

If the stairs 3 are swung in clockwise according to the drawing, the rope 27 relaxes, and the spring 26 also turns the handrail 9 clockwise until the swinging arms 5*a*, 5*b* and the handrail 9 lie almost horizontally under the platform 1.

On the buoyancy element 18 or at another suitable location in the bottom area of the stairs 18, there is a pressure switch 30 that can also be supported by a pressure plate 31. For it to function, the water flow of the traveling watercraft acts on the pressure plate 31, and a spring element lying between a pressure switch 30 and pressure plate 31 yields as of a certain water pressure and actuates the pressure switch which causes the stairs to rise when the driver of the watercraft forgets to raise the stairs 3 after use and drives off. The pressure switch can be a piezo switch equipped with a radio module and an antenna that extends above the surface of the water and can be actuated by radio so that the operating cylinder 6 can be actuated.

FIG. 3 shows a schematic side view of a platform 1 on the stern of a watercraft 2 with a swinging ladder 33 attached underneath that can be swung out and folded consisting of two ladder elements 33*a*, 33*b* and held by a hinge 32 as well as an automatically unfolding handrail 9 and a bracket 34 attached under the platform 1.

Linguistically, stairs are an ascent of horizontal steps, whereas a ladder is an ascent with rungs. For stairs that are swingable, a mechanism is needed that keeps the stairs positionally stable during the swinging process and is ideally realized by means of a parallelogram as depicted in FIGS. 1 and 2.

A simpler version is to swing out a ladder; however, in most cases, the platforms are too short to install underneath a ladder that is sufficiently long that, when in a swung-out state, extends sufficiently deep into the water to offer swimmers a comfortable rung height to easily climb back onto the swimming platform.

This disadvantage is overcome with the foldable and swingable swinging ladder 33. The swinging ladder 33 is fastened to the chassis 28 by means of the pivot bearing 23, and the chassis 28 is mounted under the platform 1. The operating cylinder 6 is attached to the chassis 28 and engages the ladder element 33*a*. On one side it has the pivot bearing connection, and on the opposite side is the hinge 32 to which the ladder element 33*b* is connected. Attached to the ladder element 33*b*, ideally directly on the hinge 32, is a cam 35 that can also be a roller and, when the swinging ladder 33 is swung up following arrow S, it collides at a specific point with the bracket 34 on the ramp 36, and the cam 35 thereby pushes the ladder element 33*b* upward until it is folded more-or-less horizontally and finally rests on the ladder element 33*a*. A rubber buffer element ensures that minimal noise arises at the end stop. The bracket 34 can be fastened under the platform 1 or on the stern of the watercraft 2, ideally adjustably, so that the cam 35 and the ramp 36 fit each other. The ramp 36 can be designed in any shape and arrangement angle with the aim of ensuring that the ladder element 33*b* folds upward smoothly and reliably.

The swinging ladder 33 can also have a hand rail that automatically extends and retracts in that a pin 25 is attached to the ladder element 33*a* and has a pulley 37 that is spring-loaded—for example by means of a leg spring—and the pulley 37 is connected to the chassis 28 by means of the rope 27. When the swinging ladder 33 is in the swung-out position, the rope 27 is taut and the handrail has rolled off under the swinging motion by means of the rope 27 of the pulley 37 and is on the stop at a given point. The front stop on the handrail 9 is precisely adjusted by means of the longitudinally adjustable stop 29. When the swimming ladder 33 is swung in, the handrail 9 rotates inward under the spring force of the spring 26 and corresponding to the available length of the rope 27 until the ladder element 33*a* reaches the stop under the platform 1, or the stroke length of the operating cylinder 6, and briefly before the end stop, the locking pin 39 engages in the pulley 37 in the recess 38 in the edge of the pulley 37 which ensures that, when the watercraft 2 is traveling in choppy waves, the handrail 9 does not always swing downward uncontrolled against the spring force but is instead held by the locking pin 39.

To ensure that the operating cylinder 6, in the event that it is a hydraulic cylinder, does not slowly creep downward out of the end position below the platform 1 so that the handrail 9 is no longer reliably held in position by the locking pin 39, this can be detected sufficiently early by an angle or distance sensor and activate the hydraulics if necessary in order to bring the swinging ladder 33 back into home position. This can be achieved more easily by means of a switch (not shown) that contacts the upper stop when the swinging ladder 33 is swung in; however, when the swinging ladder 33 sinks downward uncontrolled, the contact is broken and the swinging ladder 33 is moved back. Another version is to start the hydraulics after a specific interval while the watercraft 2 is traveling, and the swinging ladder 33 always attempts to move upward.

Of course, the invention is not restricted to the depicted and described exemplary embodiments.

LIST OF REFERENCE NUMBERS

1 Platform
2 Watercraft
3 Stairs which can swing out
4*a*, 4*b* Steps
4*c* Backrest
5*a*, 5*b* Swinging arm
6 Operating cylinder
7 Emergency switch
8 Safety switch
9 Handrail
10 Rotary bar
11 Pivot bearing
12 Cavitation plate
13 Z-drive
14 Technical means
15 Ladder
16 Rungs
17 Cover
18 Buoyancy element
19 Steps
20 LED lamps
21 Adjusting rod
22 Ladder grip
23 Pivot bearing
24 Recess
25 Pin
26 Spring
27 Rope
28 Chassis
29 Stop
30 Pressure switch
31 Pressure plate
32 Hinge
33 Swinging ladder
33*a*, 33*b* Ladder elements
34 Bracket
35 Cam
36 Ramp
37 Pulley
38 Recess
39 Locking pin
40 Contact switch
3, 33 Stairway
K Folding path for step 4*b*
S Swinging path for stairs 3
WL Waterline
X Swinging path for ladder 15

The invention claimed is:

1. A stairway
wherein
the stairway has a chassis which is attached under the platform, and
the stairs have swinging arms which can be swung out by means of an operating cylinder with a positionally constant horizontal step and at least one positionally constant horizontal step on which a pivot bearing is attached,
the swinging ladder has ladder elements that can be swung out by means of an operating cylinder connected to hinge, and a cam is attached to the ladder element and positively controls the ladder element upon contacting the bracket in order to swing it up to the ladder element,
a pin is attached to the swinging arm or the ladder element and the handrail is mounted thereupon by being pivoted, and a spring acts between the handrail and swinging arm or ladder element, and a rope is attached directly or indirectly by means of the pulley on the handrail, and the other rope end is attached to the chassis, and
when the stairway is in a closed state, the swinging arms relative to the steps and the platform, or the ladder element relative to the ladder element and to the platform, are more-or-less parallel to each other and are accessible when swung out.

2. The stairway according to claim 1,
wherein
a foldable ladder is attached to the pivot bearing of the stair and can be unfolded manually or positively controlled by means of an adjusting rod and ladder grip.

3. The stairway, according to claim 1,
wherein
the step can be folded up, moved longitudinally, or has a backrest.

4. The stairway according to claim 1, wherein
the step has a hydrodynamics shape or a buoyancy element on the bottom side which generates static or dynamic buoyancy.

5. The stairway according to claim 4,
wherein
the buoyancy body has steps, or a recess, or a V-shaped deadrise.

6. The stairway according to claim 1,
wherein
LED lamps are integrated in the step or in the buoyancy body and automatically shine when traveling backwards.

7. The stairway according to claim 1,
wherein
a pressure switch, or an emergency switch, or a contact switch or a safety switch, or an angle or stroke sensor is attached under the platform.

8. The stairway according to claim 7,
wherein
the contact switch generates contact only when pressure is relieved and moves the stairway back upward, and this function is overlooked when intentionally swinging out the stairway.

9. The stairway according to claim 1, wherein the step or the buoyancy body also serves as a trim tab and wave suppressor.

10. The stairway according to claim 1, wherein the stairs which can be swung out have a controller which detects the position of the stairs by means of the safety switch under the platform and, when the stairs are not in a fully elevated position, the watercraft motor can only achieve a maximum, predetermined engine speed, or a warning tone sounds when the watercraft engine starts, or the stairs cannot be lowered when the stern drive is tilted upward or when the stern drive assumes a steering angle.

11. The stairway according to claim 1, wherein the operating cylinder functions hydraulically or electrically.

12. The stairway according to wherein the parallelogram consists of the two swinging arms, and one of the swinging arms has a correspondingly dimensioned U-profile so that the other swinging arm can fit within it, or a separate cover encloses the parallelogram, or the distance of the two swinging arms relative to each other prevents body members from being clamped.

13. The stairway according to claim 1, wherein the locking pin locks the handrail when the stairway is closed.

14. The stairway according to claim 1, wherein the pressure switch is a piezo switch.

* * * * *